US012156618B2

(12) United States Patent
Chen et al.

(10) Patent No.: US 12,156,618 B2
(45) Date of Patent: Dec. 3, 2024

(54) BIDET, TOILET COVER PLATE, AND INTELLIGENT TOILET

(71) Applicant: Kohler (China) Investment Co., Ltd., Shanghai (CN)

(72) Inventors: Feixiang Chen, Shanghai (CN); Shiping Cheng, Shanghai (CN); Xuedan Zhu, Shanghai (CN)

(73) Assignee: Kohler (China) Investment Co., Ltd., Shanghai (CN)

( * ) Notice: Subject to any disclaimer, the term of this patent is extended or adjusted under 35 U.S.C. 154(b) by 0 days.

(21) Appl. No.: 17/885,192

(22) Filed: Aug. 10, 2022

(65) Prior Publication Data

US 2023/0069531 A1 Mar. 2, 2023

(30) Foreign Application Priority Data

Aug. 31, 2021 (CN) ..... 202122084850.2

(51) Int. Cl.
*A47K 13/30* (2006.01)

(52) U.S. Cl.
CPC ..... *A47K 13/302* (2013.01)

(58) Field of Classification Search
CPC ..... A47K 13/302
See application file for complete search history.

(56) References Cited

U.S. PATENT DOCUMENTS 4,734,942 A * 4/1988 Blanchard ..... A47K 13/302 4/233
7,543,339 B1 * 6/2009 Harris ..... E03D 1/01 4/445
2004/0172742 A1 * 9/2004 Ermini ..... A47K 13/302 4/233
2017/0275867 A1 * 9/2017 Hashimoto ..... E03D 9/08
2020/0375417 A1 * 12/2020 Thorne ..... A47K 13/24
2022/0112704 A1 * 4/2022 Garrels ..... A61L 2/22

FOREIGN PATENT DOCUMENTS

EP 1416840 A1 5/2004
WO 03015597 A1 2/2003
WO 2020247380 A1 12/2020

OTHER PUBLICATIONS

Extended European Search Report from European Patent Application No. 22190896.5, dated Apr. 1, 2023, 8 pages.

* cited by examiner

*Primary Examiner* — J C Jacyna
(74) *Attorney, Agent, or Firm* — Lempia Summerfield Katz LLC

(57) ABSTRACT

The present disclosure discloses a bidet, comprising: a seat ring comprising a rear portion; an accommodating tank disposed at the rear portion of the seat ring and comprising a front side tank wall, wherein at least one tank wall through hole is disposed on the front side tank wall of the accommodating tank; a liquid reservoir configured to store disinfectant and disposed in the accommodating tank; and at least one atomizing nozzle disposed in the accommodating tank and comprising a liquid inlet end communicated with the liquid reservoir and a liquid outlet end communicated with the at least one tank wall through hole. The present disclosure also discloses a toilet cover plate comprising a seat cover and the bidet and discloses an intelligent toilet comprising a controller; a toilet body; and the toilet cover plate.

17 Claims, 10 Drawing Sheets

BIDET, TOILET COVER PLATE, AND INTELLIGENT TOILET

CROSS REFERENCE TO RELATED APPLICATION

This application claims the benefit of priority to Chinese Patent Application No. 202122084850.2 filed in the Chinese Intellectual Property Office on Aug. 31, 2021, which is hereby incorporated by reference in its entirety.

FIELD

The present disclosure relates to the technical field of bathroom devices, and more particularly, to a bidet, a toilet cover plate, and an intelligent toilet.

BACKGROUND

A toilet includes a toilet body and a toilet cover plate installed on the toilet body. The toilet cover plate includes a bidet and a seat cover. The bidet is a seat ring assembly.

In the prior art, to sterilize and disinfect the toilet, a disinfectant is usually sprayed onto the toilet cover plate and sprayed into the toilet body, and then the toilet is scrubbed with a rag.

The existing toilet requires time-consuming and laborious manual operations for the sterilization and disinfection. It is impossible to disinfect dead corners by manually spraying the disinfectant, such as a back of the seat cover, a gap between the bidet and the seat cover, an inner wall of the toilet body, and other positions. After spraying the disinfectant, wiping the toilet with a rag is easy to cause a secondary pollution.

In light of the above drawbacks, it is necessary to provide a bidet, a toilet cover plate, and an intelligent toilet that can automatically perform the sterilization and disinfection.

SUMMARY

The present disclosure aims at providing a bidet, a toilet cover plate, and an intelligent toilet that can automatically perform the sterilization and disinfection.

In an embodiment, the present disclosure provides a bidet, including a seat ring, a liquid reservoir for storing disinfectant, and at least one atomizing nozzle.

A rear portion of the seat ring is provided with an accommodating tank, and the liquid reservoir is located in the accommodating tank.

A front side tank wall of the accommodating tank is provided with a tank wall through hole.

The atomizing nozzle is located in the accommodating tank. A liquid inlet end of the atomizing nozzle is communicated with the liquid reservoir, and a liquid outlet end of the atomizing nozzle is communicated with the tank wall through hole.

In another embodiment, the accommodating tank is provided with more than two atomizing nozzles arranged at intervals. Accordingly, the front side tank wall is provided with more than two tank walls through holes arranged at intervals.

The liquid inlet end of each atomizing nozzle is communicated with the liquid reservoir, and the liquid outlet end of each atomizing nozzle is communicated with one tank wall through hole.

In another embodiment, the liquid outlet end of the atomizing nozzle is inserted in the tank wall through a hole.

In another embodiment, the liquid inlet end of the atomizing nozzle is connected to a liquid outlet of the liquid reservoir through a liquid supply hose.

In another embodiment, a spring is installed in the liquid supply hose.

In another embodiment, the liquid reservoir is internally provided with a liquid pump.

In another embodiment, the atomizing nozzle includes a nozzle shell with an installation cavity, an atomizing sheet with a spray hole, and a piezoelectric sheet connected to one side of the atomizing sheet.

The liquid inlet end and the liquid outlet end are respectively arranged on the nozzle shell and are respectively communicated with the installation cavity.

The atomizing sheet and the piezoelectric sheet are located in the installation cavity, and the spray hole faces the liquid outlet end.

In another embodiment, the spray hole and the liquid outlet end are coaxially arranged.

In another embodiment, the piezoelectric sheet is a piezoelectric ring surrounding the spray hole.

In another embodiment, a liquid inlet of the liquid reservoir extends above a top cover plate of the accommodating tank.

A plug cover is detachably installed on the liquid inlet of the liquid reservoir.

In another embodiment, the accommodating tank is provided with a clamping groove, and the liquid reservoir is clamped in the clamping groove.

In another embodiment, the present disclosure further provides a toilet cover plate, including a seat cover and the bidet described in any of the above embodiments.

A cover plate rotating shaft is installed in the accommodating tank, and the seat ring and the seat cover are connected to the cover plate rotating shaft respectively.

In another embodiment, the present disclosure further provides an intelligent toilet, including a controller, a toilet body, and the toilet cover plate described in any of the above embodiments.

The toilet cover plate is installed on the toilet body.

The atomizing nozzle is in signal connection with the controller.

The foregoing embodiments may achieve the following beneficial effects:

The bidet, the toilet cover plate, and the intelligent toilet of the present disclosure stores the disinfectant in the liquid reservoir. When performing the sterilization and disinfection, the atomizing nozzle operates to atomize the disinfectant into sterilization mist, which can sterilize an entire area enclosed by the seat cover and can also sterilize and disinfect a gap between the seat ring and the seat cover, an inner wall of the toilet body, and other positions. Thus, the secondary pollution may be avoided, and performances of the product may be improved.

DETAILED DESCRIPTION

Figure 1:
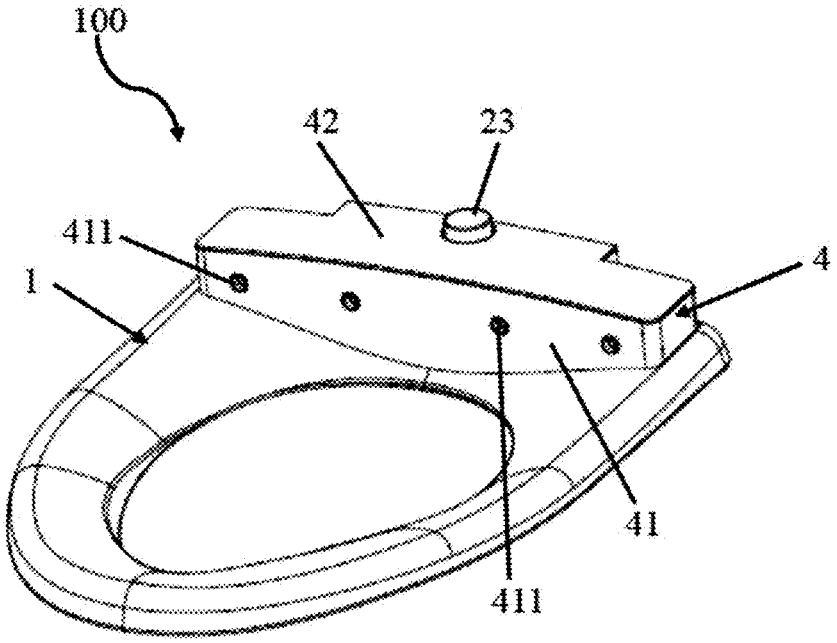
FIG. 1 is a perspective view of a bidet according to an embodiment of the present disclosure.

The specific embodiments of the present disclosure are further described with reference to the drawings hereinafter. Same or equivalent parts are denoted by same reference numerals. It should be noted that the terms "front," "back," "left," "right," "up," and "down" used in the following description refer to the directions in the accompanying drawings, and the terms "inner" and "outer" refer to the directions toward or far away from geometric centers of a specific parts respectively.

As shown in FIG. 1-FIG. 5, an embodiment of the present disclosure provides a bidet 100, including a seat ring 1, a liquid reservoir 2 for storing disinfectant, and at least one atomizing nozzle 3.

A rear portion of the seat ring 1 is provided with an accommodating tank 4, and the liquid reservoir 2 is located in the accommodating tank 4.

A front side tank wall 41 of the accommodating tank 4 is provided with a tank wall through hole 411.

The atomizing nozzle 3 is located in the accommodating tank 4. A liquid inlet end 313 of the atomizing nozzle 3 is communicated with the liquid reservoir 2, and a liquid outlet end 314 of the atomizing nozzle 3 is communicated with the tank wall through hole 411.

The bidet 100 according to the present disclosure is a part of the toilet (e.g., a seat ring assembly) and includes the seat ring 1, the liquid reservoir 2, the at least one atomizing nozzle 3, and the accommodating tank 4.

Figure 10:
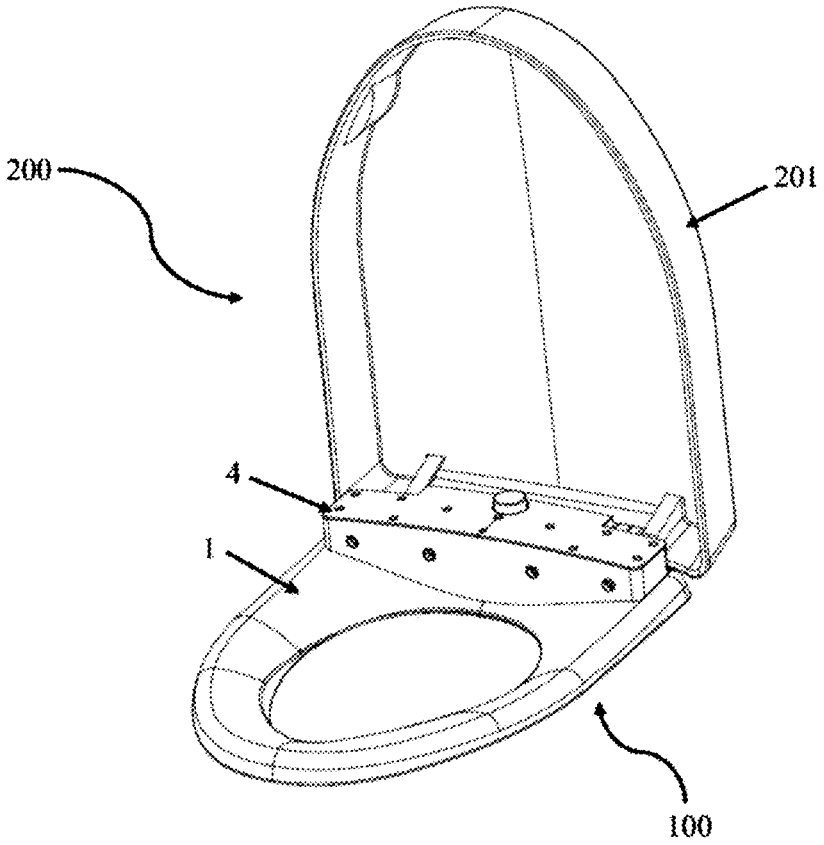
FIG. 10 is a perspective view of a toilet cover plate according to an embodiment of the present disclosure.
Figure 11:
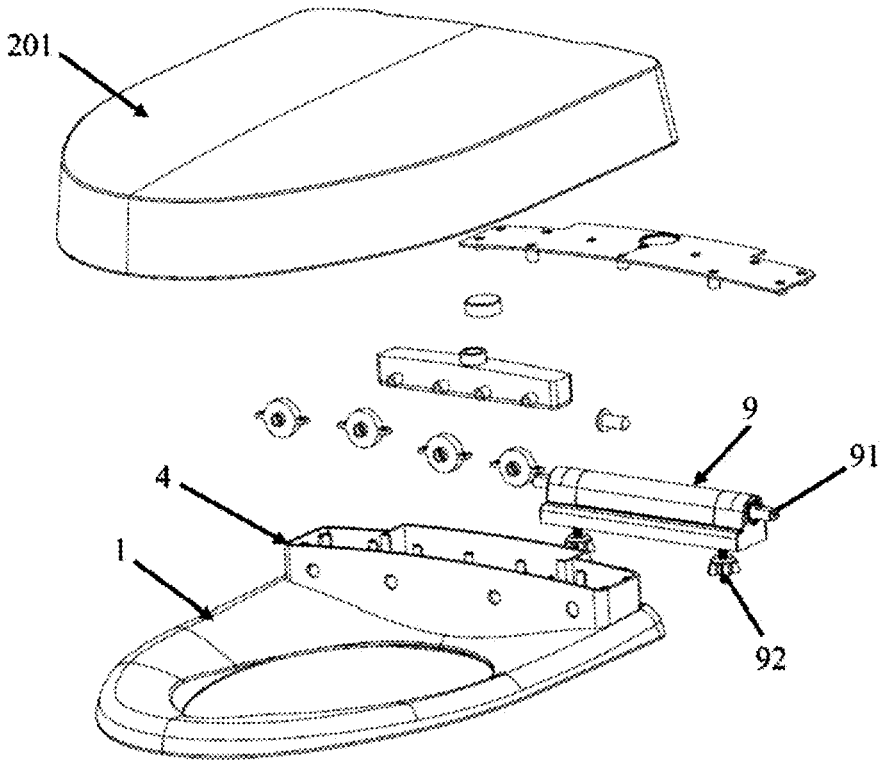
FIG. 11 is an exploded view of the toilet cover plate according to an embodiment of the present disclosure.

The accommodating tank 4 is installed at a rear end of the seat ring 1, and the accommodating tank 4 is configured to install a connecting piece 9 shown in FIG. 11. The connecting piece 9 includes a cover plate rotating shaft 91 and a bolt connector 92. The cover plate rotating shaft 91 is configured to assemble the seat ring 1 and a seat cover 201 shown in FIG. 10 and FIG. 11 together, so that both the seat ring 1 and the seat cover 201 can rotate around the cover plate rotating shaft 91. The bolt connector 92 is configured to fix the seat ring 1 to a toilet body 301 shown in FIG. 12.

The liquid reservoir 2 is configured to store disinfectant, and the liquid reservoir 2 is installed in the accommodating tank 4. The front side tank wall 41 of the accommodating tank 4 is provided with the tank wall through hole 411, and the number of the tank wall through hole 411 corresponds to the number of the atomizing nozzle 3.

The atomizing nozzle 3 is a nozzle configured to atomize the disinfectant and may be an ultrasonic atomizing nozzle. The atomizing nozzle 3 is installed in the accommodating tank 4. The liquid inlet end 313 of the atomizing nozzle 3 is communicated with the liquid reservoir 2. The liquid outlet end 314 of the atomizing nozzle 3 is communicated with the tank wall through hole 411.

According to the user's need, a liquid outlet 22 may be arranged at a bottom portion or a lower portion of the accommodating tank 4, and the liquid inlet end 313 of the atomizing nozzle 3 may be connected to the liquid outlet 22 through a pipeline. As long as a liquid level of the disinfectant is higher than the liquid outlet 22, the disinfectant can flow to the atomizing nozzle 3.

The atomizing nozzle 3 may be connected to a controller in the intelligent toilet, and the operation of the atomizing nozzle 3 is controlled by the controller to realize the automatic sterilization and disinfection.

When performing the sterilization and disinfection, the atomizing nozzle 3 operates to atomize the disinfectant into sterilization mist, which can sterilize an entire area enclosed by the seat cover 201 and can also sterilize a gap between the seat ring 1 and the seat cover 201, an inner wall of the toilet body 301, and other positions. Thus, a secondary pollution may be avoided, and the performances of the product may be improved.

Figure 2:
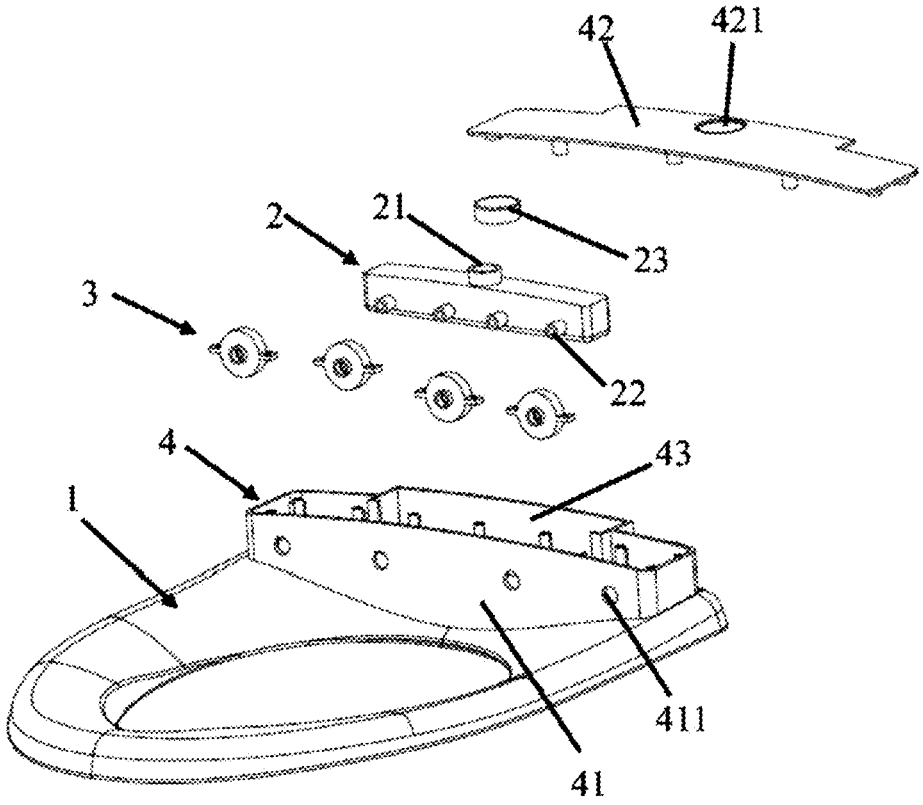
FIG. 2 is an exploded view of the bidet according to an embodiment of the present disclosure.
Figure 3:
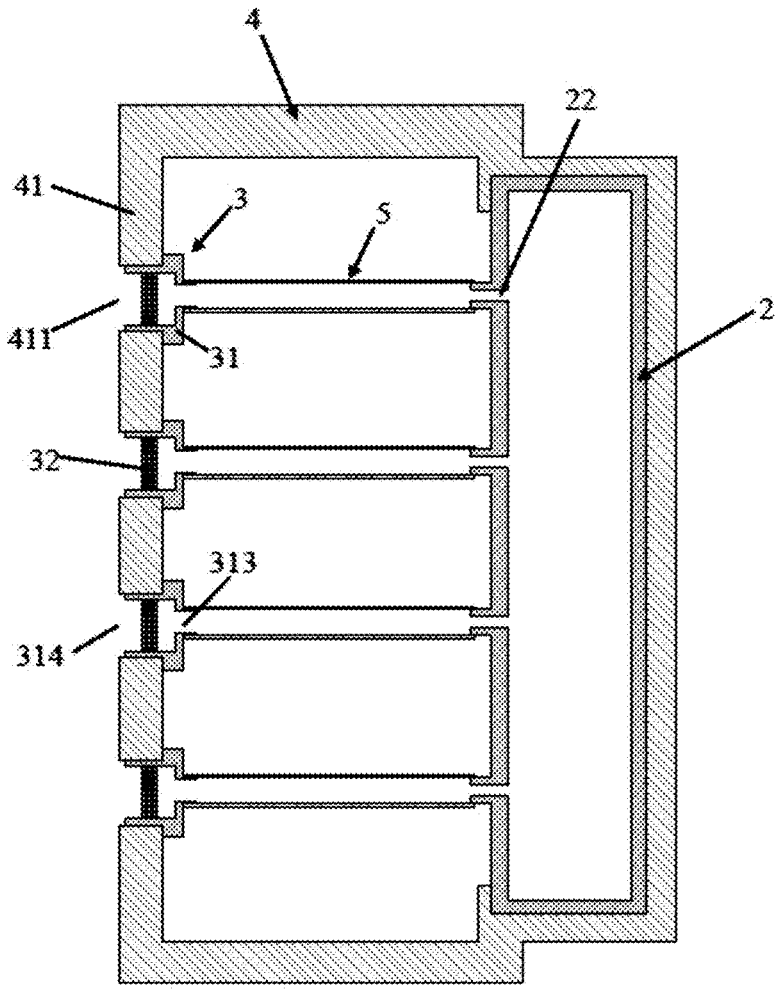
FIG. 3 is a sectional view of the bidet according to an embodiment of the present disclosure.

In one embodiment, as shown in FIG. 1-FIG. 3, the accommodating tank 4 is provided with more than two atomizing nozzles 3 arranged at intervals or spaced apart from each other and thus the front side tank wall 41 is provided with more than two tank wall through holes 411 arranged at intervals or spaced apart from each other.

The liquid inlet end 313 of each atomizing nozzle 3 is communicated with the liquid reservoir 2, and the liquid outlet end 314 of each atomizing nozzle 3 is communicated with one tank wall through hole 411.

In this embodiment, the plurality of atomizing nozzles 3 and tank wall through holes 411 are arranged at intervals or spaced apart from each other along a width direction of the seat ring 1, which can improve the sterilization and disinfection efficiency.

Figure 4:
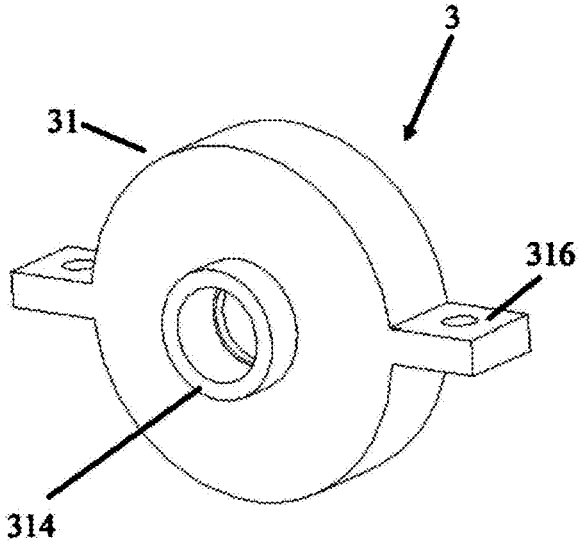
FIG. 4 is a perspective view of an atomizing nozzle.
Figure 5:
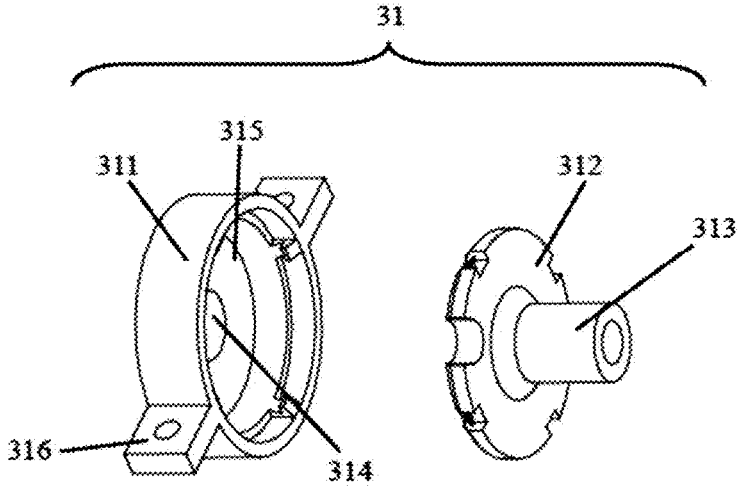
FIG. 5 is an exploded view of a shell of the atomizing nozzle.

In one embodiment, as shown in FIG. 3 and FIG. 4, the liquid outlet end 314 of the atomizing nozzle 3 is inserted into the tank wall through hole 411.

The liquid outlet end 314 may be a liquid outlet pipe, which is sealed and inserted into the tank wall through hole 411, such that the atomized sterilization mist is directly sprayed out. Thus, the sterilization and disinfection effect may be improved.

In one embodiment, as shown in FIG. 3, the liquid inlet end 313 of the atomizing nozzle 3 is connected to a liquid outlet 22 of the liquid reservoir 2 through a liquid supply hose 5. The liquid supply hose 5 may be bent in the accommodating tank 4, so as to conveniently connect the liquid inlet end 313 to the liquid outlet 22 of the liquid reservoir 2.

Figure 8:
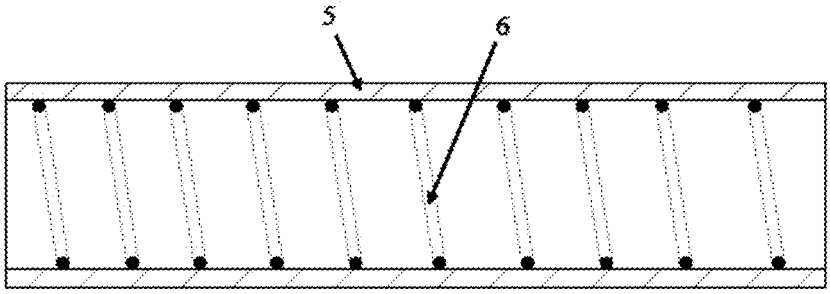
FIG. 8 is a schematic diagram of a liquid supply hose with a spring installed therein.

In one embodiment, as shown in FIG. 8, a spring 6 is installed in the liquid supply hose 5, which can prevent unsmooth flow of the disinfectant caused by wrinkling of the liquid supply hose 5.

Figure 9:
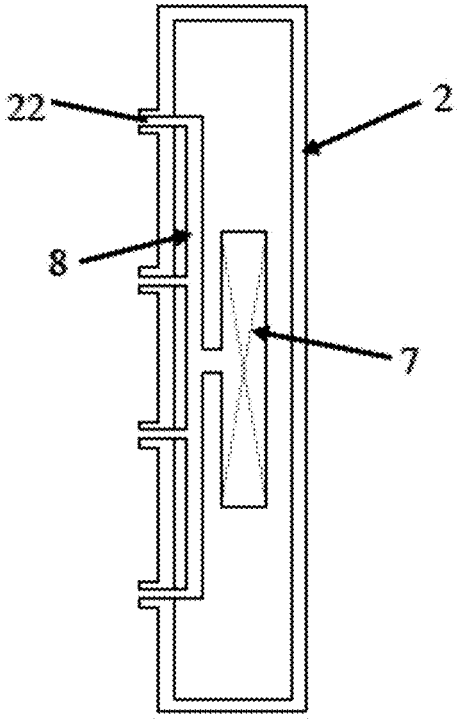
FIG. 9 is a schematic diagram of a liquid reservoir internally provided with a liquid pump.

In one embodiment, as shown in FIG. 9, the liquid reservoir 2 is internally provided with a liquid pump 7.

The liquid pump 7 may be a micro water pump. The liquid pump 7 is connected to the controller of the intelligent toilet, and the controller controls to turn on/off the liquid pump 7. The liquid pump 7 is configured to deliver the disinfectant in the liquid reservoir 2 to the atomizing nozzle 3. The liquid pump 7 may be directly connected to the liquid inlet end 313 of the atomizing nozzle 3 through a pipeline 8. The liquid pump 7 may also be connected to the liquid outlet 22 of the liquid reservoir 2 through the pipeline 8.

In one embodiment, as shown in FIG. 4-FIG. 7, the atomizing nozzle 3 includes a nozzle shell 31 comprising an installation cavity 315, an atomizing sheet 32 comprising a spray hole 321, and a piezoelectric sheet 33 connected to one side of the atomizing sheet 32.

The liquid inlet end 313 and the liquid outlet end 314 are respectively arranged on the nozzle shell 31 and are respectively communicated with the installation cavity 315.

The atomizing sheet 32 and the piezoelectric sheet 33 are located in the installation cavity 315, and the spray hole 321 faces the liquid outlet end 314.

In this embodiment, the atomizing nozzle 3 includes the nozzle shell 31, the atomizing sheet 32, and the piezoelectric sheet 33. The nozzle shell 31 is formed by clamping a front shell 311 and a rear shell 312. The nozzle shell 31 is provided with the installation cavity 315, and the installation cavity 315 is formed between the front shell 311 and the rear shell 312. The liquid inlet end 313 is arranged on the rear shell 312, and the liquid outlet end 314 is arranged on the front shell 311. The liquid inlet end 313 may be a liquid inlet or a liquid inlet pipe arranged on the rear shell 312, and the liquid outlet end 314 may be a liquid outlet or a liquid outlet pipe arranged on the front shell 311. The front shell 311 is provided with an ear plate 316, and the ear plate 316 may be connected to a base plate of the accommodating tank 4 by a screw.

A middle portion of the atomizing sheet 32 is provided with a spray hole 321, and the spray hole 321 includes a plurality of micropores distributed in an array. The atomization sheet 32 may be a ceramic atomizing sheet or a metal atomizing sheet, which may be driven to vibrate by the piezoelectric sheet 33.

The piezoelectric sheet 33 is installed on one side of the atomizing sheet 32. The piezoelectric sheet 33 may be a piezoelectric ceramic sheet.

The atomizing sheet 32 and the piezoelectric sheet 33 constitute an ultrasonic vibrator.

The atomizing sheet 32 and the piezoelectric sheet 33 are respectively connected to an oscillating circuit board 34 through one electrode 35. The oscillating circuit board 34 may be hermetically installed in the installation cavity 315 or installed outside the atomizing nozzle 3.

The oscillating circuit board 34 is connected to the controller 303 of the intelligent toilet. When the oscillating circuit board 34 is energized, a high-frequency vibration current is provided, and an oscillating frequency is 1.7 MHz or 2.4 MHz. The piezoelectric sheet 33 and the atomizing sheet 32 may generate high-frequency resonance. The high-frequency resonance disperses water molecules containing the disinfectant to produce natural and elegant disinfectant water mist, and the disinfectant water mist is ejected out through the spray hole 321 to achieve the spray and disinfection effect.

In one embodiment, the spray hole 321 and the liquid outlet end 314 are coaxially arranged, which is beneficial to directly spray the disinfectant water mist to the liquid outlet end 314.

Figure 6:
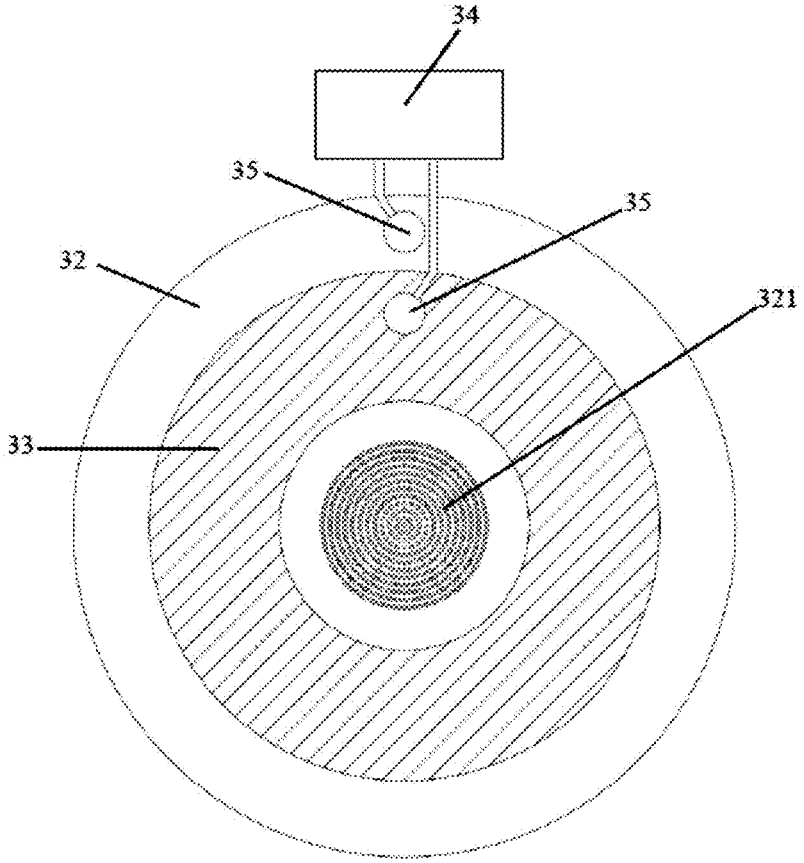
FIG. 6 is a schematic diagram showing connections among an atomizing sheet, a piezoelectric sheet, and an oscillating circuit.
Figure 7:
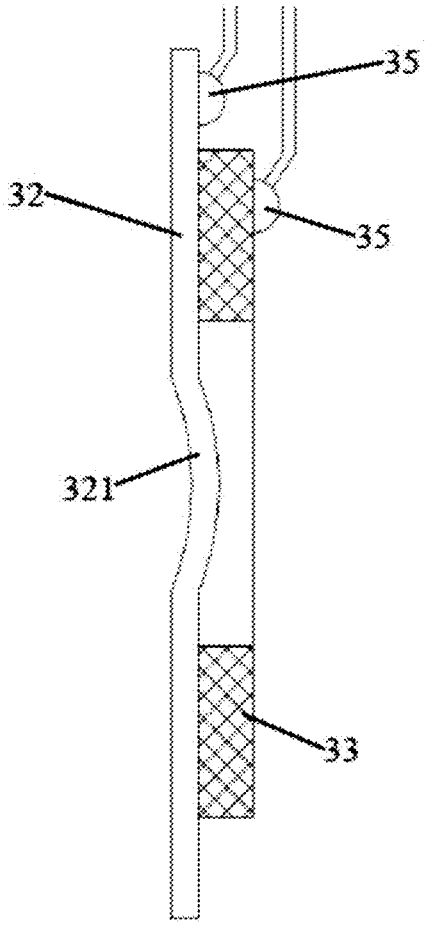
FIG. 7 is a side view of the piezoelectric sheet and the atomizing sheet.

In one embodiment, as shown in FIG. 6 and FIG. 7, the piezoelectric sheet 33 is a piezoelectric ring surrounding the spray hole 321, so that the resonance surrounding the spray hole 321 is uniform to improve the spray effect.

In one embodiment, as shown in FIG. 1 and FIG. 2, a liquid inlet 21 of the liquid reservoir 2 extends above a top cover plate 42 of the accommodating tank 4. A plug cover 23 is detachably installed on the liquid inlet 21 of the liquid reservoir 2.

When the disinfectant needs to be replenished, the plug cover 23 is opened, and the disinfectant is poured into the liquid reservoir 2 through the liquid inlet 21, so as to facilitate the replenishment operation of the disinfectant.

In one embodiment, as shown in FIG. 2 and FIG. 3, the accommodating tank 4 is provided with a clamping groove 43, and the liquid reservoir 2 is clamped in the clamping groove 43, which facilitates the disassembly and installation of the liquid reservoir 2.

As shown in FIG. 10 and FIG. 11, a toilet cover plate 200 according to an embodiment of the present disclosure includes a seat cover 201 and the bidet 100 described in any of the foregoing embodiments.

A cover plate rotating shaft 91 is installed in the accommodating tank 4, and the seat ring 1 and the seat cover 201 are connected to the cover plate rotating shaft 91 respectively.

The toilet cover plate 200 according to the present disclosure includes a seat cover 201 and a bidet 100.

For the structure, the configuration, and the working principle of the bidet 100 discussed above are incorporated herein. Thus, the description of bidet 100 have been omitted here.

A connecting piece 9 is installed in the accommodating tank 4, and the connecting piece 9 includes a cover plate rotating shaft 91 and a bolt connector 92. The seat ring 1 and the seat cover 201 are respectively connected to the cover plate rotating shaft 91, and the seat ring 1 and the seat cover 201 both can rotate around the cover plate rotating shaft 91. The bolt connector 92 is configured to fix the seat ring 1 to a toilet body 301 shown in FIG. 12.

When the seat cover 201 is closed, a closed space is formed between the toilet body 301 and the seat cover 201. When the atomizing nozzle 3 is turned on, the sterilization mist spreads in the closed space. The seat cover 201, the seat ring 1, and the toilet body 301 are immersed in the sterilization mist and completely disinfected and sterilized, so that a complete sterilization and disinfection without dead spaces can be achieved. After the atomization disinfection for a period of time, the disinfection is completed, and the atomization function can be turned off for normal use.

Figure 12:
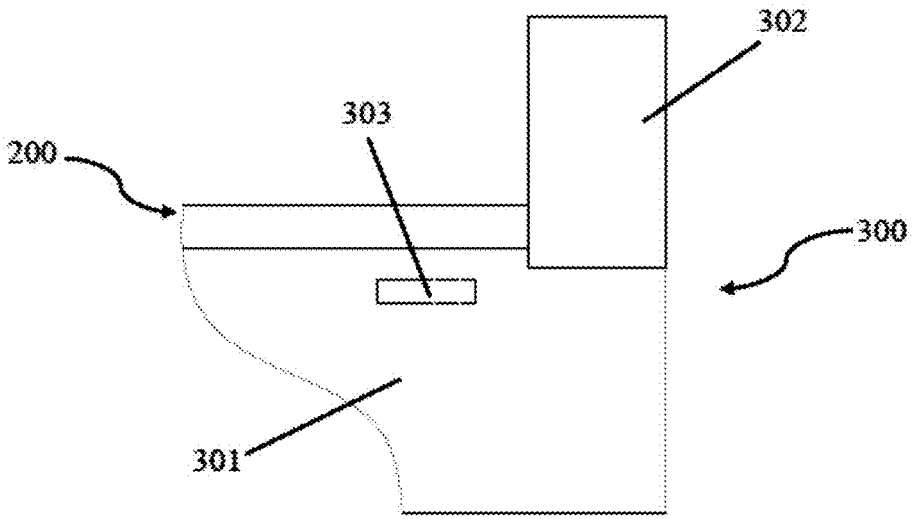
FIG. 12 is a schematic structural diagram of an intelligent toilet according to an embodiment of the present disclosure.

As shown in FIG. 12, an intelligent toilet 300 according to an embodiment of the present disclosure includes a controller 303, a toilet body 301, and the toilet cover plate 200 described in any of the forgoing embodiments.

The toilet cover plate 200 is installed on the toilet body 301. The atomizing nozzle 3 is communicably connected to the controller 303.

The intelligent toilet 300 provided by the embodiment of the present disclosure includes the toilet body 301, a water tank 302 arranged at a rear end of the toilet body 301, a control panel arranged at one side of the toilet body 301, and the toilet cover plate 200.

The control panel includes the controller 303. The accommodating tank 4 is located in the water tank 302.

The sterilization and disinfection operations may be used with the control panel to realize automatic operations, and the users can directly use the intelligent toilet without waiting.

Specifically, after monitoring that the toilet cover plate 200 is closed (e.g., after a predetermined waiting time period, for example, 5 seconds, 8 seconds, or the like according to the need), the controller 303 sends a signal to turn on the atomizing nozzle 3. After the atomization disinfection are carried out for a predetermined time period, for example, 10 seconds, 20 seconds, or the like, the sterilization and disinfection operations are completed, and the controller 303 sends a signal to turn off the atomizing nozzle 3. The atomization disinfection time period and the waiting time period may be set according to the actual test disinfection effect.

According to the user's needs, the above embodiments may be combined to improve technical effects.

Figure 13:
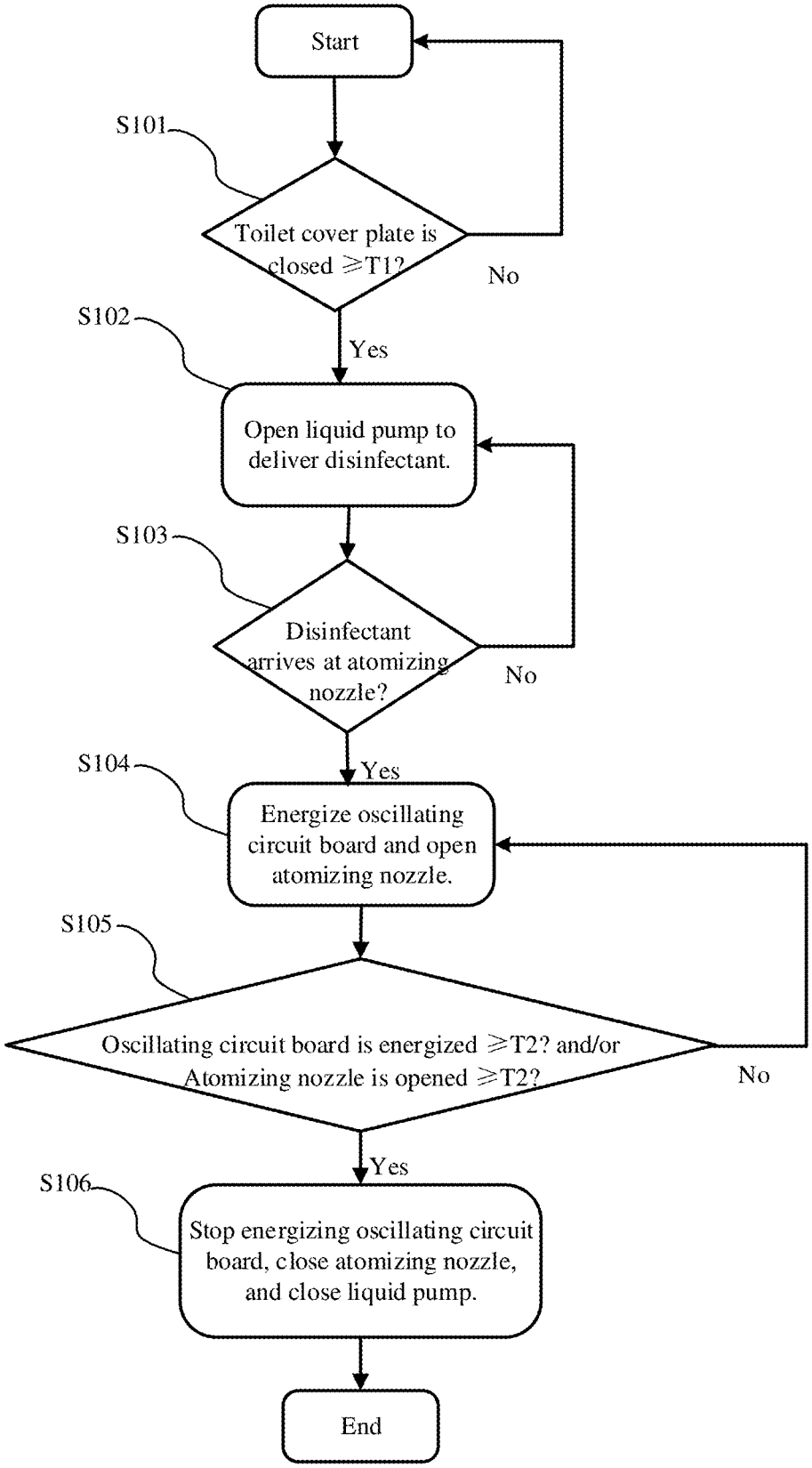
FIG. 13 is a flow chart of a method for sterilizing the toilet cover plate and the intelligent toilet by using the bidet according to an embodiment of the present disclosure.

FIG. 13 is a flow chart of a method for sterilizing the toilet cover plate 200 and the intelligent toilet 300 by using the bidet 100 according to an embodiment of the present disclosure. The bidet 100 and the toilet cover plate 200 are discussed above and may be controlled by a controller 303 of the intelligent toilet 300 configured to perform an operation, function, or the like as described in the present disclosure. The above descriptions of the bidet 100, the toilet cover plate 200, and the intelligent toilet 300 are incorporated herein.

At act S101, the controller 303 may determine whether the toilet cover plate 200 is in a closed state for a predetermined waiting time period T1 or longer. Specifically, the controller 303 may determine whether the bidet 100 and the seat cover 201 are both in the closed state for the predetermined waiting time period T1 or longer. The intelligent toilet 300 may further comprise at least one sensor configured to determine an angle of the bidet 100 relative to an upper rim of a toilet bowl of the intelligent toilet 300 and determine an angle of the seat cover 201 relative to the upper rim of the toilet bowl of the intelligent toilet 300. When the bidet 100 or the seat cover 201 approximately has an angle of 0 degree relative to the upper rim of the toilet bowl of the intelligent toilet 300, the controller 303 may determine that the bidet 100 or the seat cover 201 is in the closed state.

The intelligent toilet 300 may further comprise a timer configured to count a time period during which the toilet cover plate 200 is in the closed state. In an embodiment, the timer may stop counting the time period during which the toilet cover plate 200 is in the closed state and may be reset when the user opens the toilet cover plate 200. In another embodiment, the timer may stop counting the time period during which the toilet cover plate 200 is in the closed state when the user opens the toilet cover plate 200. In this embodiment, the timer is not reset, and the counted time period may be accumulated or added.

The predetermined waiting time period T1 may be, for example, 5 seconds, 8 seconds, etc.

At act S102, when the toilet cover plate 200 is in the closed state for the predetermined waiting time period T1 or longer (Yes in S101), the controller 303 may open the liquid pump 7 and control the liquid pump 7 to deliver the disinfectant in the liquid reservoir 2 to the atomizing nozzle 3.

At act S103, the controller 303 may determine whether the disinfectant arrives at the atomizing nozzle 3. Specifically, the intelligent toilet 300 may further comprise at least one sensor configured to determine a velocity of the disinfectant flowing through the liquid inlet end 313 of the atomizing nozzle 3. When the velocity of the disinfectant flows through the liquid inlet end 313 at a velocity equal to or larger than a predetermined velocity, the controller 303 may determine that the disinfectant arrives at the atomizing nozzle 3.

At act S104, when the disinfectant arrives at the atomizing nozzle 3 (Yes in S103), the controller 303 may energize the oscillating circuit board 34 and open the atomizing nozzle 3. Specifically, when the oscillating circuit board 34 is energized, a high-frequency vibration current is provided, and an oscillating frequency is 1.7 MHz or 2.4 MHz. The piezoelectric sheet 33 and the atomizing sheet 32 may generate high-frequency resonance. The high-frequency resonance disperses water molecules containing the disinfectant to produce natural and elegant disinfectant water mist. The disinfectant water mist is ejected out through the spray hole 321 by opening the atomizing nozzle 3 to achieve the spray and disinfection effect. In an embodiment, the atomizing nozzle 3 may be opened at the same time when the oscillating circuit board 34 is energized.

At act S105, the controller 303 may determine whether the oscillating circuit board 34 is in an energized state for a predetermined time period T2 or longer and/or the atomizing nozzle 3 is in an open state for the predetermined time period T2 or longer. The intelligent toilet 300 may further comprise at least one timer configured to count a time period during which the oscillating circuit board 34 is in the energized state for the predetermined time period T2 or longer and/or a time period during which the atomizing nozzle 3 is in the open state for the predetermined time period T2 or longer.

At act S106, when the oscillating circuit board 34 is in the energized state and/or the atomizing nozzle 3 is in the open state for the predetermined time period T2 or longer (Yes in S105), the controller may stop energizing the oscillating circuit board 34, close the atomizing nozzle 3, and close the liquid pump 7. The sterilization process is completed.

In an embodiment, when the toilet cover plate 200 is in the closed state for less than the predetermined waiting time period T1 (No in S101), the method may restart the sterilization process. In this embodiment, when the user opens the toilet cover plate 200 before the counted time period during which the toilet cover plate 200 is in the closed state reaches the predetermined waiting time period T1, the method may restart the sterilization process and the timer may be reset.

In another embodiment, when the accumulated time period during which the toilet cover plate 200 is in the closed state is less than the predetermined waiting time period T1 (No in S101), the timer may continue to count the time period during which the toilet cover plate 200 is in the closed state. In this embodiment, the method does not restart the sterilization process and the timer is not reset.

When the disinfectant does not arrive at the atomizing nozzle 3 (No in S103), the method may return to S102 to continue the delivery of the disinfectant by the liquid pump.

When the oscillating circuit board 34 is in the energized state for less than the predetermined time period T2 and/or the atomizing nozzle 3 is in the open state for less than the predetermined time period T2 (No in S105), the method may return to S104 to continue to energize the oscillating circuit board 34 and open the atomizing nozzle 3.

The above descriptions only illustrate the principles and the embodiments of the present disclosure. It should be pointed out that for those of ordinary skill in the art, other modifications can be made based on the principle of the present disclosure. The modifications should also be regarded as falling within the scope of protection of the present disclosure.

We claim:

1. A bidet, comprising:

a seat ring comprising a rear portion;

an accommodating tank disposed at the rear portion of the seat ring and comprising a front side tank wall, wherein at least one tank wall through hole is disposed on the front side tank wall of the accommodating tank;

a liquid reservoir configured to store disinfectant and disposed in the accommodating tank; and at least one atomizing nozzle disposed in the accommodating tank and comprising a liquid inlet end communicated with the liquid reservoir and a liquid outlet end communicated with the at least one tank wall through hole, wherein the liquid inlet end of the at least one atomizing nozzle is connected to a liquid outlet of the liquid reservoir through a liquid supply hose and a spring is installed in the liquid supply hose.

2. The bidet according to claim 1, wherein the at least one atomizing nozzle comprises a plurality of atomizing nozzles spaced apart from each other, wherein the at least one tank wall through hole comprises a plurality of tank wall through holes spaced apart from each other, wherein the liquid inlet end of each of the plurality of atomizing nozzles is communicated with the liquid reservoir, and wherein the liquid outlet end of each of the plurality of atomizing nozzles is communicated with one tank wall through hole of the plurality of tank wall through holes.

3. The bidet according to claim 1, wherein the liquid outlet end of the at least one atomizing nozzle is inserted into the at least one tank wall through hole.

4. The bidet according to claim 1, wherein a liquid pump is disposed in the liquid reservoir.

5. The bidet according to claim 1, wherein the at least one atomizing nozzle comprises:

a nozzle shell comprising an installation cavity;

an atomizing sheet comprising at least one spray hole; and a piezoelectric sheet connected to one side of the atomizing sheet, wherein the liquid inlet end of the at least one atomizing nozzle and the liquid outlet end of the at least one atomizing nozzle are respectively disposed on the nozzle shell and are respectively communicated with the installation cavity, wherein the atomizing sheet and the piezoelectric sheet are disposed in the installation cavity, and wherein the at least one spray hole faces the liquid outlet end of the at least one atomizing nozzle.

6. The bidet according to claim 5, wherein the at least one spray hole and the liquid outlet end of the at least one atomizing nozzle are coaxially arranged.

7. The bidet according to claim 5, wherein the piezoelectric sheet is a piezoelectric ring surrounding the at least one spray hole.

8. The bidet according to claim 1, wherein a liquid inlet of the liquid reservoir extends out of a top cover plate of the accommodating tank; and wherein a plug cover is detachably installed on the liquid inlet of the liquid reservoir.

9. The bidet according to claim 1, wherein the accommodating tank comprises a clamping groove, and wherein the liquid reservoir is clamped in the clamping groove.

10. A toilet cover plate, comprising:

a seat cover; and a bidet, comprising:

a seat ring comprising a rear portion;

an accommodating tank disposed at the rear portion of the seat ring and comprising a front side tank wall, wherein at least one tank wall through hole is disposed on the front side tank wall of the accommodating tank;

a liquid reservoir configured to store disinfectant and disposed in the accommodating tank; and at least one atomizing nozzle disposed in the accommodating tank and comprising a liquid inlet end communicated with the liquid reservoir and a liquid outlet end communicated with the at least one tank wall through hole, wherein a cover plate rotating shaft is installed in the accommodating tank, and wherein the seat ring and the seat cover are connected with the cover plate rotating shaft respectively, wherein the at least one atomizing nozzle comprises:

a nozzle shell comprising an installation cavity;

an atomizing sheet comprising at least one spray hole; and a piezoelectric sheet connected to one side of the atomizing sheet, wherein the liquid inlet end of the at least one atomizing nozzle and the liquid outlet end of the at least one atomizing nozzle are respectively disposed on the nozzle shell and are respectively communicated with the installation cavity, wherein the atomizing sheet and the piezoelectric sheet are disposed in the installation cavity, and wherein the at least one spray hole faces the liquid outlet end of the at least one atomizing nozzle.

11. The toilet cover plate according to claim 10, wherein the at least one atomizing nozzle comprises a plurality of atomizing nozzles spaced apart from each other, wherein the at least one tank wall through hole comprises a plurality of tank wall through holes spaced apart from each other, wherein the liquid inlet end of each of the plurality of atomizing nozzles is communicated with the liquid reservoir, and wherein the liquid outlet end of each of the plurality of atomizing nozzles is communicated with one tank wall through hole of the plurality of tank wall through holes.

12. The toilet cover plate according to claim 10, wherein the liquid outlet end of the at least one atomizing nozzle is inserted into the at least one tank wall through hole.

13. The toilet cover plate according to claim 10, wherein the at least one spray hole and the liquid outlet end of the at least one atomizing nozzle are coaxially arranged.

14. The toilet cover plate according to claim 10, wherein the piezoelectric sheet is a piezoelectric ring surrounding the at least one spray hole.

15. An intelligent toilet, comprising:

a controller;

a toilet body; and a toilet cover plate disposed on the toilet body, the toilet cover plate comprising:

a seat cover; and a bidet, comprising:

a seat ring comprising a rear portion;

an accommodating tank disposed at the rear portion of the seat ring and comprising a front side tank wall, wherein at least one tank wall through hole is disposed on the front side tank wall of the accommodating tank;

a liquid reservoir configured to store disinfectant and disposed in the accommodating tank; and at least one atomizing nozzle disposed in the accommodating tank and comprising a liquid inlet end communicated with the liquid reservoir and a liquid outlet end communicated with the at least one tank wall through hole, wherein a cover plate rotating shaft is installed in the accommodating tank, wherein the seat ring and the seat cover are connected with the cover plate rotating shaft respectively, and wherein the at least one atomizing nozzle is communicably connected to the controller, wherein the at least one atomizing nozzle comprises:

a nozzle shell comprising an installation cavity;

an atomizing sheet comprising at least one spray hole; and a piezoelectric sheet connected to one side of the atomizing sheet, wherein the liquid inlet end of the at least one atomizing nozzle and the liquid outlet end of the at least one atomizing nozzle are respectively disposed on the nozzle shell and are respectively communicated with the installation cavity, wherein the atomizing sheet and the piezoelectric sheet are disposed in the installation cavity, and wherein the at least one spray hole faces the liquid outlet end of the at least one atomizing nozzle.

16. The intelligent toilet according to claim 15, further comprising an oscillating circuit board communicably connected to the controller, wherein the atomizing sheet and the piezoelectric sheet are respectively connected to the oscillating circuit board through an electrode, and wherein when the oscillating circuit board is energized to generate a high-frequency vibration current, and the atomizing sheet and the piezoelectric sheet generate a high-frequency resonance configured to produce disinfectant water mist.

17. A bidet, comprising:

a seat ring comprising a rear portion;

an accommodating tank disposed at the rear portion of the seat ring and comprising a front side tank wall, wherein at least one tank wall through hole is disposed on the front side tank wall of the accommodating tank;

a liquid reservoir configured to store disinfectant and disposed in the accommodating tank; and at least one atomizing nozzle disposed in the accommodating tank and comprising a liquid inlet end communicated with the liquid reservoir and a liquid outlet end communicated with the at least one tank wall through hole, wherein a liquid inlet of the liquid reservoir extends out of a top cover plate of the accommodating tank; and wherein a plug cover is detachably installed on the liquid inlet of the liquid reservoir.

* * * * *